United States Patent [19]

Devir et al.

[11] Patent Number: 5,029,057

[45] Date of Patent: Jul. 2, 1991

[54] CLIPPED TOGETHER LAMP BASE

[75] Inventors: Daniel D. Devir, S. Sutton; James P. Szep, Peterborough, both of N.H.

[73] Assignee: GTE Products Corporation, Danvers, Mass.

[21] Appl. No.: 438,149

[22] Filed: Nov. 20, 1989

[51] Int. Cl.[5] ..... F21V 15/04

[52] U.S. Cl. ..... 362/226; 362/61; 362/306; 362/390; 313/318

[58] Field of Search ..... 362/61, 226, 267, 306, 362/390; 439/544, 588; 313/318

[56] References Cited

U.S. PATENT DOCUMENTS

| | | | |
|---|---|---|---|
| 4,473,770 | 9/1984 | Baba et al. | 362/226 X |
| 4,547,838 | 10/1985 | Wakimizu | 362/267 X |
| 4,573,754 | 3/1986 | Hill | 339/60 |
| 4,631,651 | 12/1986 | Bergin et al. | 362/267 |
| 4,647,132 | 3/1987 | Mikola | 339/91 L |
| 4,687,965 | 8/1987 | Sanders et al. | 362/267 X |
| 4,789,920 | 12/1988 | Helbig et al. | 362/267 X |
| 4,804,343 | 2/1989 | Reedy | 439/854 |
| 4,822,302 | 4/1989 | Dorleans | 362/226 X |
| 4,879,491 | 11/1989 | Hirozumi et al. | 362/267 X |

*Primary Examiner*—Ira S. Lazarus
*Assistant Examiner*—Richard R. Cole
*Attorney, Agent, or Firm*—William E. Meyer

[57] ABSTRACT

A lamp base having a clipped together support structure is disclosed. Assembly and orientation of lamps is facilitated by a bulb that first clip couples to a bulb and the bulb holder is in turn clip coupled to a lamp base. Electrical connection is made through a duct traversing the bulb holder. By further enabling the bulb holder to lamp base coupling to be rotatable, the lamp pieces may be assembled in secure relation to each other in one operation, and quickly oriented in a second operation. An appropriate bond may be subsequently applied between the bulb holder and the lamp base to permanently fix the two pieces.

12 Claims, 7 Drawing Sheets

CLIPPED TOGETHER LAMP BASE

RELATED APPLICATION

Basic aspects of the present application are disclosed in a simultaneously filed application titled Vibration Resistant Lamp Base serial number, filed by the present applicants, and assigned to the same assignee.

1. Technical Field

The invention relates to electric lamps and particularly to electric lamps mounted on a lamp base. More particularly the invention is concerned with vehicle lamps mounted in a plastic base.

2. Background Art

In the drive for more efficient automobiles, lighter weight vehicles have been develope. An unnoticed aspect of lighter weight vehicles is their higher internal resonances. These resonances at times correspond to the natural frequencies of light lamp filaments. When a filament, at elevated temperature is put into resonance by an exterior driving force, such a transmitted vibration from a car, the filament life is substantially reduced. There is then a need for automobile lights that are protected from harmonic resonant destruction.

Each automobile model has a set of characteristic resonant frequencies. Designing a lamp to be protected from the resonances of one vehicle model does not assure protection against the resonant frequencies of a second vehicle model. There is then a need for automobile lamps that may be adjustably protected from the particular frequencies of different vehicle models.

The cost of an automobile lamp is due in part to the cost of the materials and energy required to form the product. It is also due in part to the time required for assembly, and the quality of assembly. A lamp that requires manual labor, or extensive machine time, reduces capital efficiency, thereby increasing the lamp cost. A lamp that is assembled poorly, requires repair, or results in wasted materials. There is then a need for lamps that may be assembled quickly. There is a corresponding need for lamps that may be assembled quickly and accurately.

Technical history is repeating itself in automobile headlights. Automobile headlights were originally formed as separate capsules inserted in reflector bodies. When the lamp capsule failed, the capsule was removed and replaced. About fifty years ago, the sealed beam headlight was developed. For several decades, almost all headlights had a filament permanently sealed in a glass reflector body. If the filament failed, the reflector and filament structure were replaced as single unit. Currently, a resurgence of the replaceable capsule is occurring. The replaceable capsule has the general form of a lamp capsule held in a holder. The holder couples and seals to a separate reflector housing. The reflectors and lamp capsules are smaller than before, and therefore require much greater accuracy in relative positioning. Automobiles are also expected to run for much longer periods without any failure of any type. There is then a need for inexpensively assembled automobile lamps that are still accurately positionable, and long lived.

Examples of the prior art are shown in U.S. Pat. No. 4,573,754 Hill; 4,641,056 Sanders; 4,631,651 Bergin; 4,647,132 Mikola; 4,752,710 Devir and 4,804,343 Reedy. U.S. Pat. No. 4,573,754 Hill shows a lamp supported by a clip in a lamp base. U.S. Pat. No. 4,641,056 Sanders shows a lamp supported by a metal cup in a metal cylinder. U.S. Pat. No. 4,631,651 Bergin shows a lamp supported by a clip in a ball and socket type lamp base. U.S. Pat. No. 4,647,132 Mikola shows a lamp supported by a clip in a lamp base. U.S. Pat. No. 4,752,710 Devir (one of the same inventors listed herein) shows a lamp supported by a clip whose structure is in part similar to the preferred embodiment suggested herein. U.S. Pat. No. 4,804,343 Reedy shows a lamp supported by a clip in a lamp base.

DISCLOSURE OF THE INVENTION

An electric lamp may be formed with a bulb having an envelope with a sealed end and electric leads emerging from the end portion, a bulb holder having a first coupling end to couple with and hold the bulb along the sealed end, the bulb holder having an internal passage to duct the lamp leads from the bulb through the bulb holder, a body supporting the first coupling end, and a second coupling end supporting the body, and a lamp base having a base coupling end to make a clipped coupling with the second coupling end to hold the bulb holder, the lamp base having lead contacts to electrically connect the electric leads, an insulating base to contain the lead contacts and duct the lead contacts to a lead connection. The clipped together structure allows quick assembly, while allowing for accurate adjustment of the light source with respect to the lamp base.

BEST MODE FOR CARRYING OUT THE INVENTION

Figure 1:
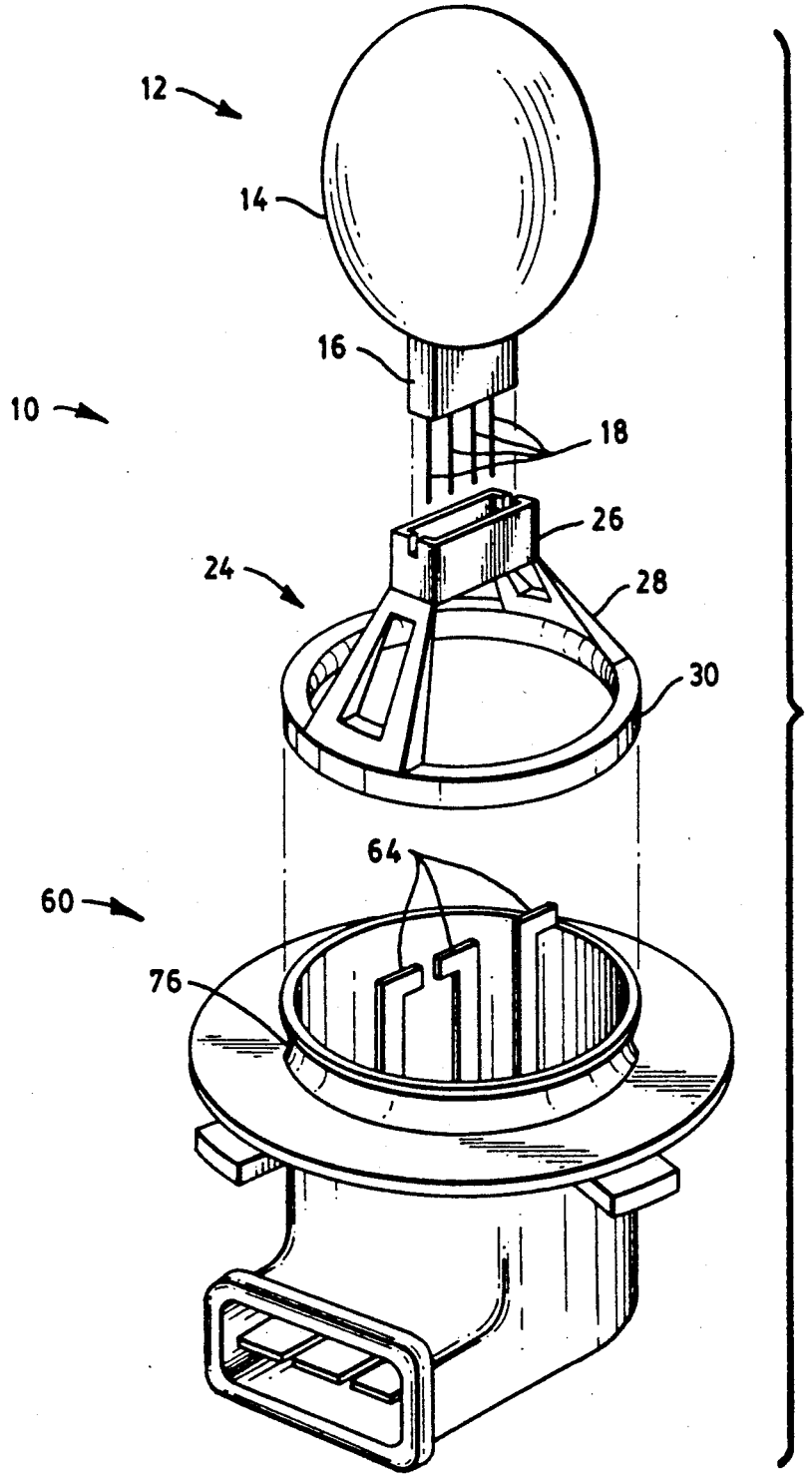
FIG. 1 shows an exploded view of a preferred embodiment of an insertable lamp.

FIG. 1 shows an exploded view of a preferred embodiment of an insertable lamp using a press sealed lamp capsule as a light source. The preferred lamp 10 is assembled from a bulb 12, a bulb holder 24, and a lamp base 60. The preferred lamp 10 is designed so the bulb 12 clips to the bulb holder 24, which in turn clips to base 60. The preferred bulb is a single ended, press sealed bulb well known in the art. The single ended bulb 12 has a light source enclosed in an envelope 14 having a press seal 16. Extending from the press seal 16 are electric leads 18.

Figure 2:
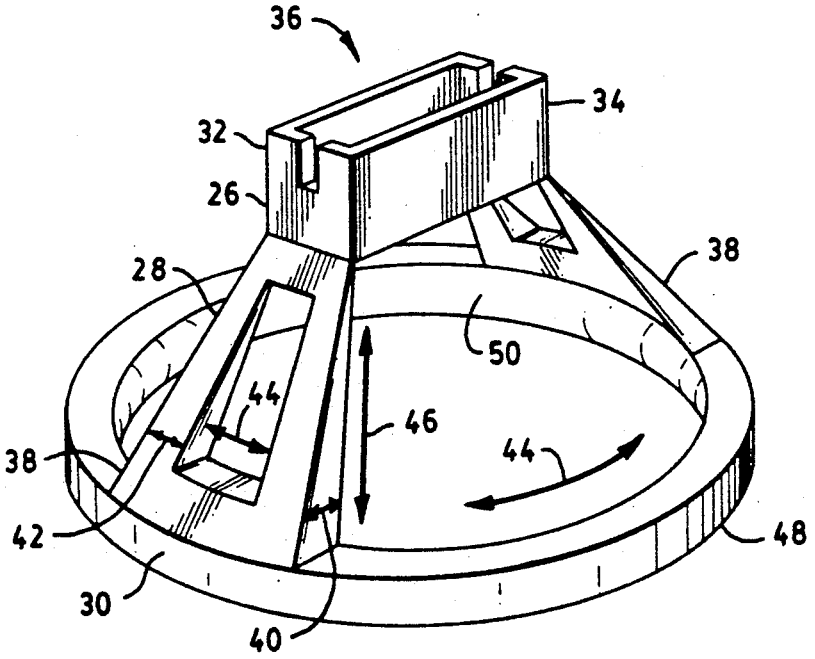
FIG. 2 shows an perspective view of a preferred embodiment of a bulb holder.
Figure 3:
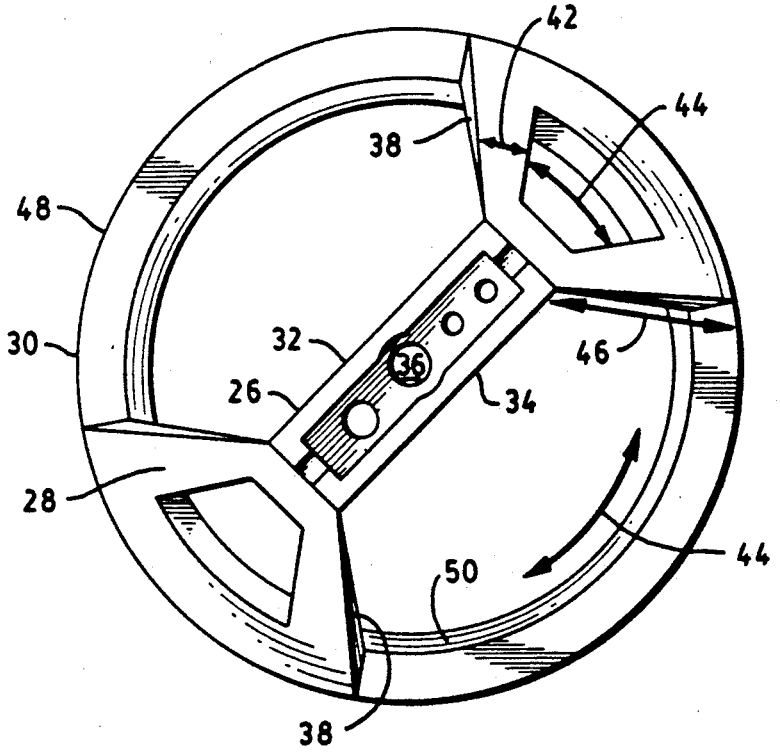
FIG. 3 shows top view of the preferred bulb holder.

FIG. 2 shows an perspective view of a preferred embodiment of a bulb holder 24, and FIG. 3 shows top view of the same bulb holder 24. The bulb holder 24 has a first coupling end 26, an intermediate body 28, and a second coupling end 30. The press seal 16 couples to the first coupling end 26. Numerous bulb 12 to bulb holder 24 coupling are known. The preferred embodiment comprises a plastic first coupling end 26 having two slightly flexible side walls 32, 34 separated by a central passage 36. Formed in the press seal 16 and the inside of the bulb holder 24 side walls 32, 34 are complementary features to position and securely hold the bulb 12 with respect to the bulb holder 24. The bulb 12 may then be inserted into the bulb holder 24 causing the side walls 32, 34 to be spread against the spring force of the first coupling end 26, and body 28. The complementary features of the press seal 16 and the side walls 32, 34 are then brought into alignment, under the spring force of the side walls 32, 34. The bulb 12 is thereby clipped to the bulb holder 24. Extending from the bulb 12, the lead wires 18, pass throughout the bulb holder 24 by means of the central passage 36.

The first coupling end 26 is joined to the body 28 that extends away from the bulb 12 and around the leads 18. The preferred body 28 has a solid region coupled to the base of the walls 32, 34 extending into a series of arms 38 radiating from the solid region. The junction of the side walls 32, 34, the solid region and arms 38 form a sufficiently solid structure to resist the spreading of the side walls 32, 34. The arms 38 have widths 40, breadths 42, separation angles 44 and lengths 46.

Applicant has found that the harmonic response of the bulb holder 24 may be tuned to help limit the destructive affects of resonance. The widths 40, breadths 42, separation angles 44 and lengths 46 may be adjusted to affect the harmonic resonance of the lamp. The preferred method of altering the body 28 for harmonic tuning is to alter the thicknesses of the first coupling end 26, or body 28 features. The form of the body 28, such as the arms 38 is then abstractly designed to include features intentionally variable as to vibrational transmission. For example, the harmonic response of the bulb holder 24 may be altered by changing the arm widths 40, arm breadths 42, or arm separation angles 44. Since altering the arm lengths 46, alters the optical placement of the light source within a standard reflector housing, it is preferable to not change the arm lengths 46. The optical placement of the light source, for example, the filament location may be preserved. The harmonic responsiveness of the bulb holder 24 may be tuned without having to reposition the bulb 12, and side walls 32, 34 with respect to a reflector 16. The bulb 12 may remain in an optically fixed position relative to the lamp base 60, while the bulb holder 24, and in particular the body 28, is adjusted for vibrational harmonics. A single standard optical design may then be used for all environments, while a selection of different bulb holders 24 may be chosen from to best fit a particular vibrational environment.

Opposite the first coupling end 26, the body 28 with the intermediate, adjustable portions is coupled to a second coupling end 30. In the preferred embodiment, the arms 38 couple to the second coupling end 30. The preferred embodiment of the second coupling end 30 is a ring 48 approximately transverse to and coaxial with the axis of the central passage 36 having a rotational coupling surface 50. The formed passage 36 passes through the second coupling end 30 thereby allowing the lamp leads 18 to pass through the axial extent of the bulb holder 24.

Figure 4:
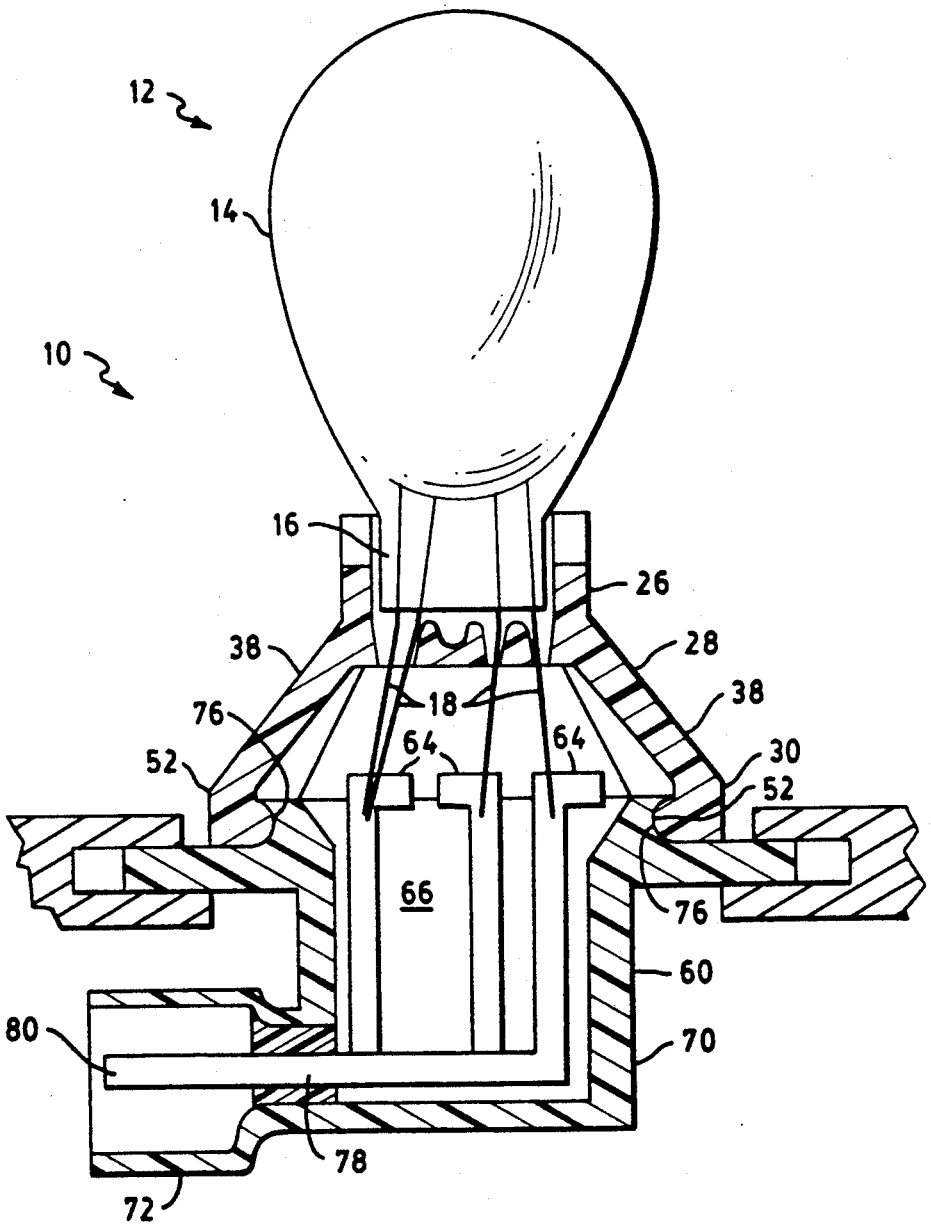
FIG. 4 shows a cross sectional view of the preferred bulb holder and lamp base coupling partially broken away.
Figure 5:
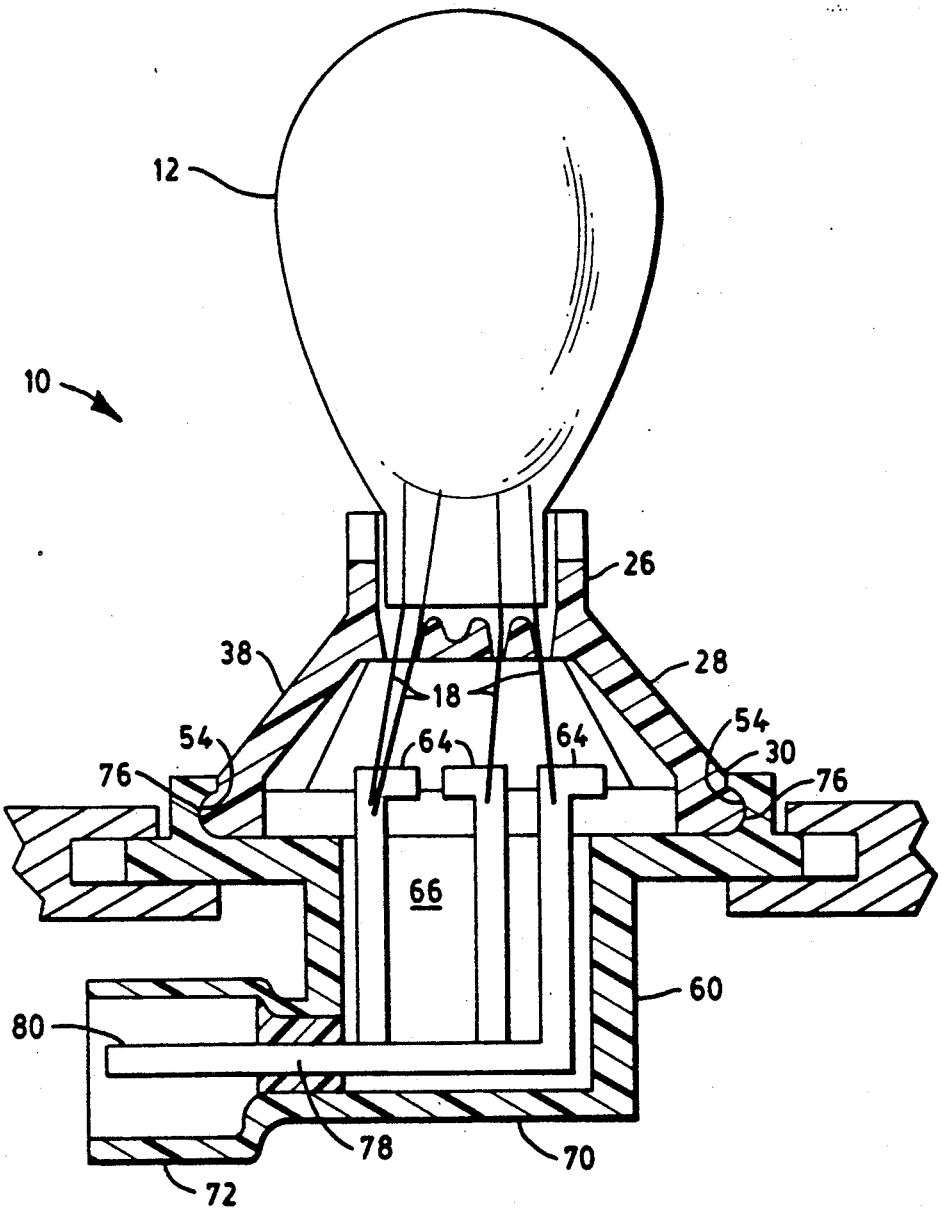
FIG. 5 shows a cross sectional view of an alternative preferred bulb holder and lamp base coupling partially broken away.
Figure 6:
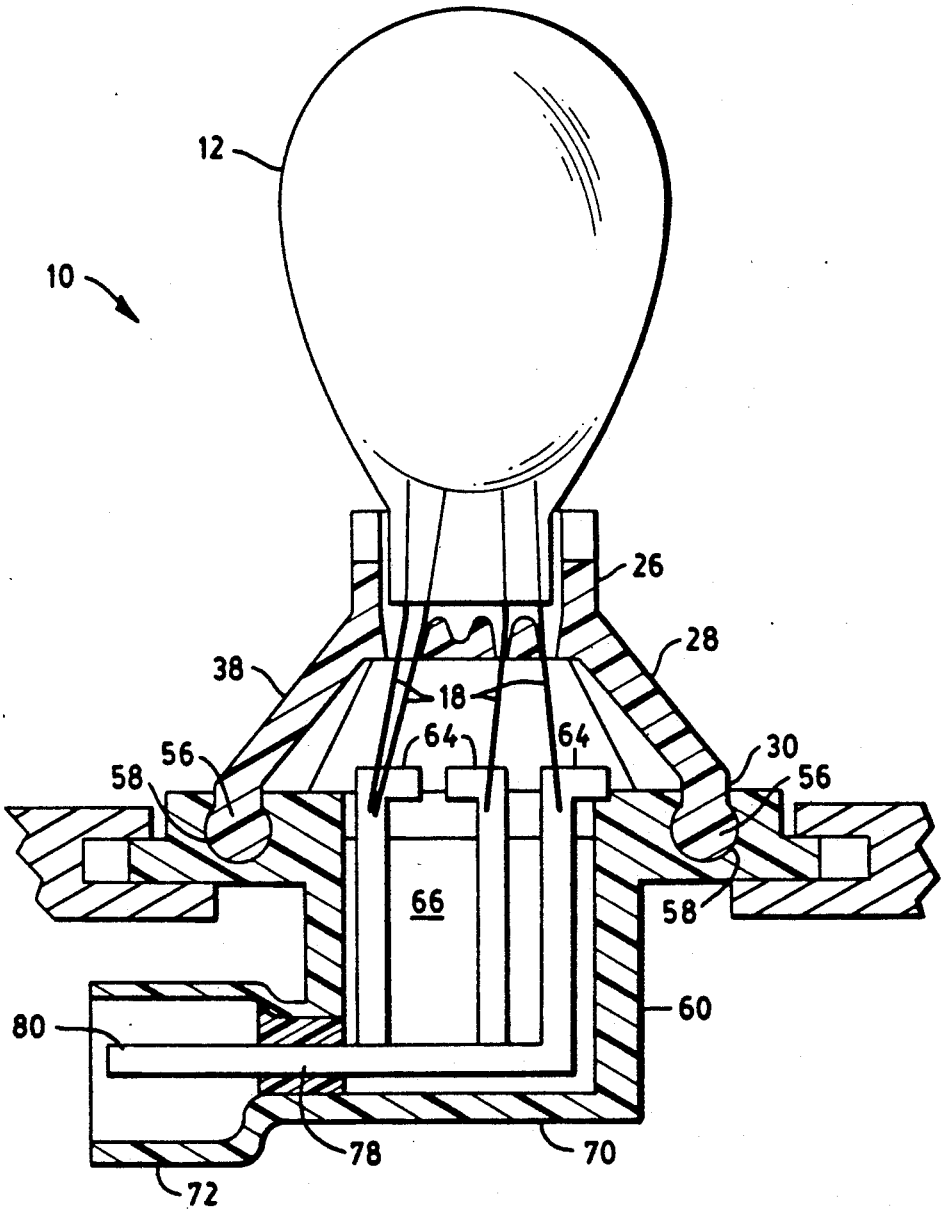
FIG. 6 shows a cross sectional view of an alternative preferred bulb holder and lamp base coupling partially broken away.

FIG. 4 shows a cross-sectional view of a bulb 12, bulb holder 24 and lamp base 60. The preferred second coupling end 30 may comprise a ring 48 with an internal facing mating surface 52, as shown in FIG. 4. In the preferred embodiment, the lamp base 60 includes a corresponding complementary surface of rotation, as in FIG. 1. With either or both of the bulb holder 24, and lamp base 60 formed from a slightly compressible material, and the two mating surfaces having nearly identical, albeit complementary dimensions, the two mating surfaces may be pressed together, forming a snapped in place, tight rotational coupling. Alternatively, FIG. 5 shows a similar structure with the mating surface relation inverted, so the mating surface is shown as an external facing mating surface 54. In a further alternative, FIG. 6 shows a similar structure wherein the coupling between the second coupling end, and the lamp base comprises a circular rib on one side, for example the bulb holder 24, fitted into a corresponding circular groove, for example formed in the surface of the lamp base flange. The rib and groove have nearly corresponding dimensions, and one or both is formed from a slightly compressible material allowing the rib to be fitted into the groove for a tight rotational coupling. The coupling aspects of the second coupling end 30, and the corresponding mating features of the lamp base 60 may be interchanged. The relevant aspects of the coupling between the bulb holder 24, and the lamp base 60 is felt to be that the bulb holder 24 may be clipped to the lamp base 60. Next, the preferred embodiment substantially sets their relative axial Positions, and once clipped together, a separate rotational adjustment may be made. The bulb holder 24 is harmonically adjustable while providing fixed format couplings with bulb 12, and the lamp base 50.

The preferred coupling surface 50 is a continuous surface of rotation forming either an internal ring 52 or an external ring 54 around the central passage 36. FIG. 4 shows a second coupling end 30 with an internal coupling surface 52 as a surface of rotation in the form of toroidal section. The bulb holder 24 is then clipped to over the lamp base coupling. FIG. 5 shows a second coupling end 30 with an external coupling surface 54 as a surface of rotation in the form of toroidal section. The bulb holder 24 is then clipped to into the lamp base coupling. FIG. 6 shows a second coupling end 30 with an external rib 56 as a surface of rotation in the form of toroidal section. The bulb holder 24 is then clipped to into a corresponding groove 58 of the lamp base 60.

The coupling surface 50 may be formed to be expansible, for example by including one or more expansion gaps or slashes in the coupling surface 50 when the coupling surface 50 is an internal ring surface 52. Alternatively, the coupling surface 50 may be made compressible when the coupling surface 50 is an external ring 54. For example, one or more a contraction gaps may be formed in the coupling surface 50 allowing the ring 48 to be expanded in its diameter. The bulb holder 24 is felt to be made weaker, and less harmonically resistant by the inclusion of expansion or contraction gaps in the second coupling end 30. It is therefore preferred that the expansion or contraction features, if any, be formed on the lamp base 60 side of the coupling. A further alternative is to form the second coupling end 30, and the lamp base coupling 62 as substantially solid pieces with sufficient compressibility to be Press fitted together. In each case, the bulb holder 24 may be quickly and easily clipped to a lamp base 60. The rotatable bulb holder 24 coupling allows radially adjustment of the light source with respect to the lamp base 60 prior to final bonding of the lamp holder 24 and lamp base 60. The addition of a glue, solder, or weldment as appropriate to the materials of chosen, allows the clipped together bulb holder 24 and lamp base 60 to become permanently bonded to fix the proper orientation of the light source to the lamp base 60.

Figure 7:
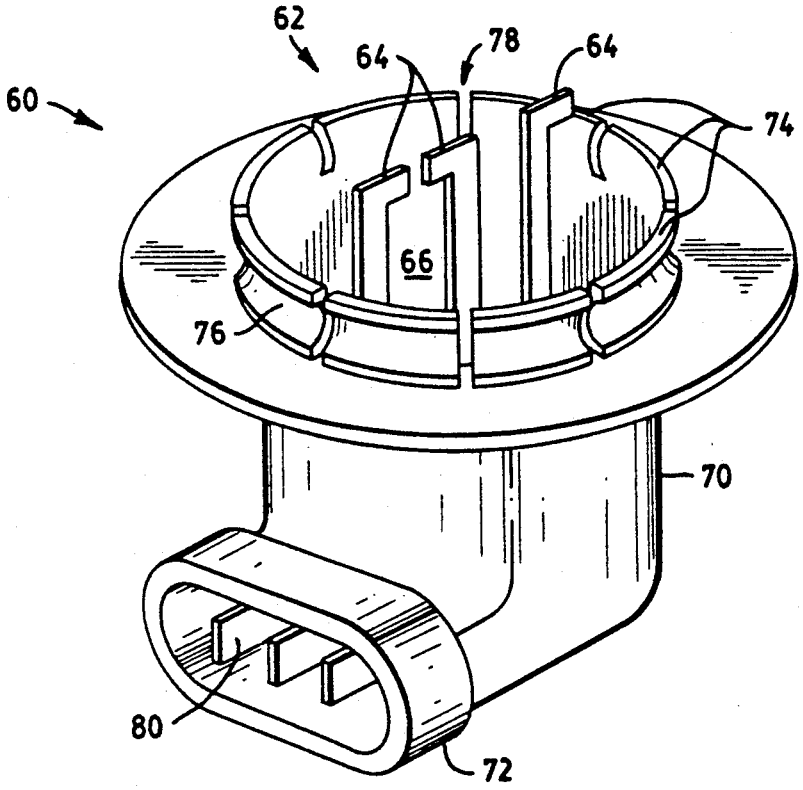
FIG. 7 shows an perspective view of a preferred embodiment of a lamp base.

The bulb holder 24 is mounted along the second coupling end 30 to the lamp base 60. FIG. 7 shows a perspective view of an alternative lamp base 60. The lamp base 60 includes a base coupling 62, enclosed lead connectors 64 passing through an insulated base body 70 for electrical connection at a formed connection end 72. The lamp base 60 may have a surface such as provided by a radial flange transverse to the coupling axis that the bulb holder 24 may rotate against. The base coupling 62 is formed to have features designed to couple with the second coupling end 30. In particular, the preferred embodiment, corresponding to the preferred embodiment of the base coupling 62 is an upstanding ring of coupling teeth 74. Each tooth 74 includes a section of a surface of rotation 76 mateable with the the coupling surface 50 carried by the second coupling end 30. The individual teeth 74 are separated by radial gaps 78. The first and second surfaces of rotation are complementary, with one preferably being radially concave, and with the corresponding other being radially convex. Each tooth 74 is further formed from a substantially stiff material having some resilience, thereby providing a flexible clipping. Each tooth 74 may then be radially compressed, or spread as the case may be, allowing the convexity of one surface of rotation to be spring fitted into the concavity of the corresponding surface of rotation. The two surfaces of rotation may then be clipped together to hold the bulb holder 24, and lamp base 60 in axial position, while allowing rotation about the axis of the bulb holder 24 and lamp base 60.

The bulb holder 24 may still be rotated axially with the internal surface of rotation riding against the external surface of rotation formed along the exterior faces of the teeth 74. Once the bulb holder 24 is rotationally aligned, a glue, or other means of bonding may be used to fix the coupling between the bulb holder 24 and lamp base 60.

The lamp leads 18 are positioned in the lamp base 60 to be in reach of coupling to the lead connectors 64. In the preferred embodiment, the lead connectors 64 extend slightly above the axial extent of the lamp base 60 to enter the volume defined by the second coupling end 30, and thereby contact or be in reach of contacting the lamp leads 18 ducted through the central passage 36. The contacts between the lamp leads 18 and the lead connectors 64 may be exposed through the adjustable portions of the bulb holder 24, so weld tools may penetrate open portions of the bulb holder 24 to weld the lamp leads 18 to the lead contacts 64 once the bulb holder 24 is rotationally adjusted. The lead connectors 64 may include middle sections 78 molded, or sealed in place in the base body 70 with opposite ends 80 exposed along the exterior in a plug housing connection end 72. The alternative lamp base 60 is further formed as a single plastic molded body having positioning and sealing features, such as guides, or keys to position the lamp base in a recepticle, a groove for a sealing 0-ring, a sealing flange, twist lock coupling prominences and grooves and similar seal and lock features known in the insertable lamp art.

Vibrational tuning of the bulb holder 24 requires first identifying the dominant frequencies to be protected against. In the case of a coiled filament, having an axis, the filament has a set of responsive frequencies transverse to the filament axis, and a second set of responsive frequencies parallel to the filament axis. The preferred embodiment for the bulb holder 24 is then tuned to have high impedance as to the filament responsive frequencies. The bulb holder 24 is then further sculpted by either the addition or removal of material from body 28, or arms 38 to resonate at a frequency that is not an integral fraction or factor of any of the dominant site frequencies.

When the lamp 10 is installed for a specific application, the site vibrations transmitted from the mounting site are transmitted to the light source from the bulb 12, bulb holder 24, and the lamp base 60. The site vibrations normally include one or more dominate frequencies. When the light source is a filament, a harmonic response between the filament and the dominant site vibrations may cause the filament to fail prematurely. By further tuning the lamp holder 24 to resonate at frequencies that are not harmonic with the dominant site frequencies, the lamp filament may be further protected from premature failure due to sympathetic resonance. In particular, each vehicle type generates, and transmits selected vibrations that distinguish it from other vehicle types. By tuning the bulb holder 24, a general lamp structure may be specialized for a particular vehicle type. The preferred embodiment for the bulb holder 24 is then tuned to have high impedance as to the filament responsive frequencies, and the site dominant frequencies.

While it is possible to individually tune a lamp to a particular vehicle, this may not be practical. A more general tuning may be accomplished by detecting the dominant frequencies in a particular vehicle model, and tuning the bulb holder 24 for the dominant frequencies found. An even broader tuning may be made by determining the dominant frequencies for a particular vehicle type. Vehicle types may include, small, medium and large automobiles, small medium and large trucks, vans, off the road vehicles, motorcycles and so on. Other vehicle type classifications may be made according to engine size, engine location, drive wheel location, fuel type, and so on all of which may present standardizable harmonic characteristics the bulb holder 24 may be tuned to resist.

The molding tools may be altered with inserts that adapt the mold shape to the desired support structure of the bulb holder 24. A single web mold may then be readily adapted by inserting various inserts to produce a variety of differently tuned bulb holders 24. Each bulb holder 24 may have a standard first coupling for the bulb 12, and a standard second coupling for the lamp base 60. Specialized runs of the various bulb holders 24 may then be made without regard to the optical design of the remaining lamp parts, or the assembly machines and procedures used in joining the parts.

The disclosed dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims. In particular, the coupling structures described for the second coupling end and the lamp base may be reversed. Also, while the preferred embodiment includes features allowing rotation of the clipped on bulb holder, rotation is not necessary to the clipped relation. Nor is clipping or rotation necessary to the vibrational tuning.

What is claimed is:

1. An electric lamp comprising:

a) a bulb having an envelope with a sealed end and electric leads emerging from the end portion, b) a bulb holder having a first coupling end to couple with and hold the bulb along the sealed end, an internal passage to duct the lamp leads from the bulb through the bulb holder, a body supporting the first coupling end, and a second coupling end supporting the body wherein the second coupling end includes a slightly compressible first mating surface, and c) a lamp base having a base coupling end to make a clipped coupling with the second coupling end to hold the bulb holder, the lamp base including a corresponding second mating surface with complementary portions of nearly equivalent dimension of the first mating surface to allow a compression snap fit mating between the second coupling end and the lamp base thereby setting the relative axial positions of the bulb holder and lamp base while remaining rotationally adjustable, the lamp base having lead contacts to electrically connect the electric leads, an insulating base to contain the lead contacts and duct the lead contacts to a lead connection.

2. The lamp in claim 1, wherein the base further includes mechanical coupling portions formed on the exterior surface to couple the base in a lamp fixture.

3. The apparatus in claim 1, wherein the sealed end includes surface features, and the bulb holder includes at least two internal wall portions defining a cavity to receive the sealed end and including corresponding surface features to couple with, and hold the bulb along the sealed end.

4. The lamp in claim 1, wherein the second coupling end includes a mating face including a portion defining a surface of rotation.

5. The lamp in claim 4, wherein the defined surface of rotation is an internal facing surface of rotation.

6. The lamp in claim 4, wherein the defined surface of rotation is an external facing surface of rotation.

7. The lamp in claim 1, wherein the lamp base coupling includes a series of flexible teeth.

8. The lamp in claim 7, wherein the series of flexible teeth are arranged in a circle.

9. The lamp in claim 7, wherein at least some of the teeth include a portion of a surface of rotation.

10. The lamp in claim 9, wherein the portion of a surface of rotation faces the exterior, to mate with an interior facing surface of rotation formed on the second coupling end.

11. The lamp in claim 9, wherein the portion of a surface of rotation faces the interior, to mate with an exterior facing surface of rotation formed on the second coupling end.

12. The lamp in claim 1, wherein the coupling between the second coupling end, and the lamp base comprises a circular rib on one side fitted into a corresponding circular groove allowing the rib to be fitted into the groove for a tight rotational coupling.

* * * * *